US011305162B2

(12) United States Patent
Ma

(10) Patent No.: US 11,305,162 B2
(45) Date of Patent: Apr. 19, 2022

(54) PULLING STRING APPARATUS OF STRINGING MACHINE

(71) Applicant: GUANGZHOU MASTRIPOD TECHNOLOGY LIMITED, Guangzhou (CN)

(72) Inventor: Yundou Ma, Guangzhou (CN)

(73) Assignee: GUANGZHOU MASTRIPOD TECHNOLOGY LIMITED, Guangzhou (CN)

( * ) Notice: Subject to any disclaimer, the term of this patent is extended or adjusted under 35 U.S.C. 154(b) by 183 days.

(21) Appl. No.: 16/762,859

(22) PCT Filed: Aug. 8, 2018

(86) PCT No.: PCT/CN2018/099421
§ 371 (c)(1),
(2) Date: May 8, 2020

(87) PCT Pub. No.: WO2019/184187
PCT Pub. Date: Oct. 3, 2019

(65) Prior Publication Data

US 2020/0306598 A1 Oct. 1, 2020

(30) Foreign Application Priority Data

Mar. 26, 2018 (CN) ..... 201820415997.0

(51) Int. Cl.
*A63B 51/14* (2006.01)
*A63B 51/16* (2006.01)
(Continued)

(52) U.S. Cl.
CPC ..... *A63B 51/16* (2015.10); *A63B 51/005* (2013.01); *A63B 2102/02* (2015.10); *A63B 2102/04* (2015.10)

(58) Field of Classification Search
CPC ..... A63B 51/12; A63B 51/005; A63B 51/14; A63B 51/16; A63B 2102/02; A63B 2102/04
See application file for complete search history.

(56) References Cited

U.S. PATENT DOCUMENTS 9,597,556 B2 3/2017 Cerf
2015/0133243 A1* 5/2015 Zdrazila ..... A63B 51/14 473/556
2016/0121176 A1* 5/2016 Cerf ..... A63B 51/14 473/557

FOREIGN PATENT DOCUMENTS

CN 2623288 Y 7/2004
CN 200951292 Y 9/2007
(Continued)

*Primary Examiner* — Raleigh W Chiu
(74) *Attorney, Agent, or Firm* — Weber Rosselli & Cannon LLP

(57) ABSTRACT

A pulling string apparatus of a stringing machine comprising a string gripper, a sensor, a drive element, a transmission mechanism and a control circuit; the sensor is connected with the string gripper to detect the pull force of the string gripper; the control circuit compares the detected pull force value with a pre-set value, and control the rotation of the drive element; the transmission mechanism comprises a mounting base, a sliding block, a transmission rack and a drive gear; wherein the drive gear is connected to the drive element and is engaged with the transmission rack, the sliding block arranged on the transmission rack is connected with the sensor; when the sensor and the string gripper are driven forward or backward by the sliding block under the act of the transmission rack engaged with the drive gear, the racket string will be tensioned or loosened.

14 Claims, 2 Drawing Sheets

(51) Int. Cl.

| | |
|---|---|
| ***A63B 51/005*** | (2015.01) |
| *A63B 102/02* | (2015.01) |
| *A63B 102/04* | (2015.01) |

(56) References Cited

FOREIGN PATENT DOCUMENTS

| | | | | | |
|---|---|---|---|---|---|
| CN | 101337121 | A | | 1/2009 | |
| CN | 202942616 | U | | 5/2013 | |
| CN | 208229329 | U | * | 12/2018 | ..... A63B 51/005 |

* cited by examiner

PULLING STRING APPARATUS OF STRINGING MACHINE

CROSS-REFERENCE TO RELATED APPLICATIONS

This application claims priority to PCT Application No. PCT/CN2018/099421, having a filing date of Aug. 8, 2018 based on Chinese application No. 201820415997.0 having a filing date of Mar. 26, 2018, the entire contents of foresaid documents are hereby incorporated by reference.

TECHNICAL FIELD

The following relates to the field of a stringing machine, and more particularly to a pulling string apparatus of a stringing machine.

BACKGROUND OF INVENTION

When playing racket sports using a tennis racket (or badminton racket), the tension in the racket string is an important factor in the effect and experience of the ball striking; therefore, tension control of the racket string is of high importance during racket stringing. In general, when stringing a racket, firstly fixing the racket with a racket fixture, then stringing in sequence, and tensioning the string with a pulling string apparatus when the string has been threaded through the hole in the racket.

Most existing pulling string apparatuses are electric pulling string apparatuses, which are distinguished from conventional hand-cranking type in that the string tensioning or releasing is achieved by electronically controlling a low-speed motor for driving a string gripper to move back and forth.

However, the string tension changes with the deformation of the resilient string, slight deformation of the string may result in a considerable change in tension. Currently, the transmission mechanism of most existing pulling string apparatuses is a screw mounted to the output shaft of the motor, and a string gripper and a sensor are mounted to a screw nut which is sleeved on the screw, so that the string gripper and the sensor may move back and forth under the control of the low-speed motor; however, such transmission mechanism has a defect that friction will be created as the screw and the nut moves, then wear and tear of the parts occurs after long-term use, which will disable the string gripper and the sensor to conduct the linear reciprocating motion, deviate the tension measured by the sensor, and influence the accuracy of the stringing.

SUMMARY OF THE INVENTION

It is an objective of the invention to provide a pulling string apparatus of a stringing machine to solve the problems above.

The objective is achieved by the following technical solutions:

Provided is a pulling string apparatus of a stringing machine comprising a string gripper, a sensor, a drive element, a transmission mechanism and a control circuit; the sensor is connected with the string gripper to detect the pull force of the string gripper, then the detected pull force value is transferred to the control circuit; the control circuit compares the detected pull force value with a pre-set value, and control the rotation of the drive element according to the comparison result; the transmission mechanism comprises a mounting base, a sliding block, a transmission rack and a drive gear; wherein the drive gear is connected to the output shaft of the drive element and is engaged with the transmission rack, the sliding block is arranged on the transmission rack and is connected with the sensor; the mounting base is configured with guide rods, wherein the sliding block is slidably mounted on the guide rods; when the sensor and the string gripper are driven forward by the sliding block under the act of the transmission rack engaged with the drive gear, the racket string will be tensioned; when the sensor and the string gripper are driven backward by the sliding block under the act of the transmission rack engaged with the drive gear, the racket string will be loosened.

In a specific embodiment, the sliding block is provided with guide holes in which the guide rods pass through.

A plurality of linear bearings are arranged in the guide holes for the sliding block to connect with slide along the guide rods, which considerably reduces the friction between the sliding block and the guide rods.

Further, the sliding block is configured with shims fixing on both ends of the sliding block by bolts to limit the movement of the linear bearings and prevent the linear bearings from falling out of the sliding block.

In a specific embodiment, the string gripper comprises a gripper base connected with the sensor and a clamp slidably mounted on the gripper base. The clamp comprises inner string slots with a slope.

In a specific embodiment, the drive element is a motor.

Further, the drive gear is connected to the output shaft of the motor by a rolling bearing.

In a specific embodiment, the pulling string apparatus further comprises two travel switches respectively mounted on two side plates arranged on the mounting base, and when the string gripper moves to the forward or backward limit position, the travel switch will send a stop signal to the drive element.

In a specific embodiment, the pulling string apparatus further comprises a display electrically connected to the control circuit for displaying the force value detected by the sensor.

Compared with the prior art, the present invention has following technical advantages:

Provided is a pulling string apparatus of the stringing machine comprising a string gripper, a sensor, a drive element, a transmission mechanism and a control circuit; the transmission mechanism comprises a mounting base, a sliding block, a transmission rack and a drive gear; the drive gear is engaged with the transmission rack, therefore, the drive element is able to drive the transmission rack to move back and forth, since the sliding block provided with string gripper and sensor is mounted on the transmission rack, the string gripper and the sensor will thereby move linearly along with the transmission rack, in this way power transmission is realized; moreover, the sliding block is slidably mounted on the guide rods on the mounting base and moves along the guide rods, wherein the friction caused by the reciprocating movement of the sliding block is considerably reduced than using a screw and nut, which greatly prolonged the lifespan of the machine, and the inaccuracy in measuring force value caused by swaying of the string gripper is thus avoided.

Further, the transmission sliding block and the transmission rack are coupled via a plurality of linear bearings, which transfers sliding friction into rolling friction to reduce the friction, enabling the sliding block move smoothly with greatly reduced resistance.

Further, the sliding block is configured with shims fixing on both ends of the sliding block to prevent the linear bearings from falling out from the sliding block, wherein the shims are fixed on the sliding block by bolts.

For a better understanding and implementation, the present invention is described in detail below with reference to the accompanying drawings.

DETAILED DESCRIPTION OF THE INVENTION

Embodiment 1

Figure 1:
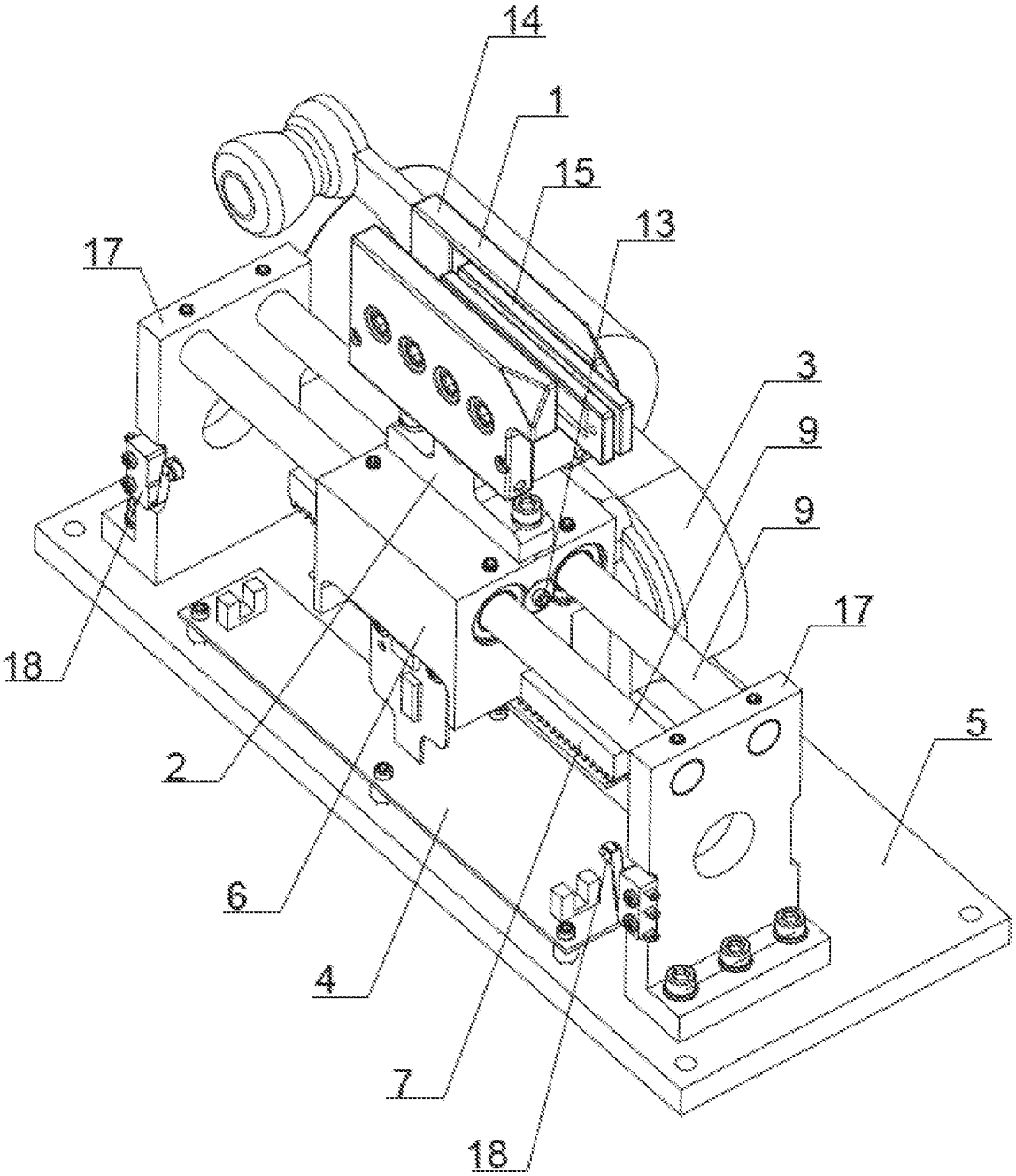
FIG. 1 is a schematic view of a pulling string apparatus of the stringing machine of the present invention.
Figure 2:
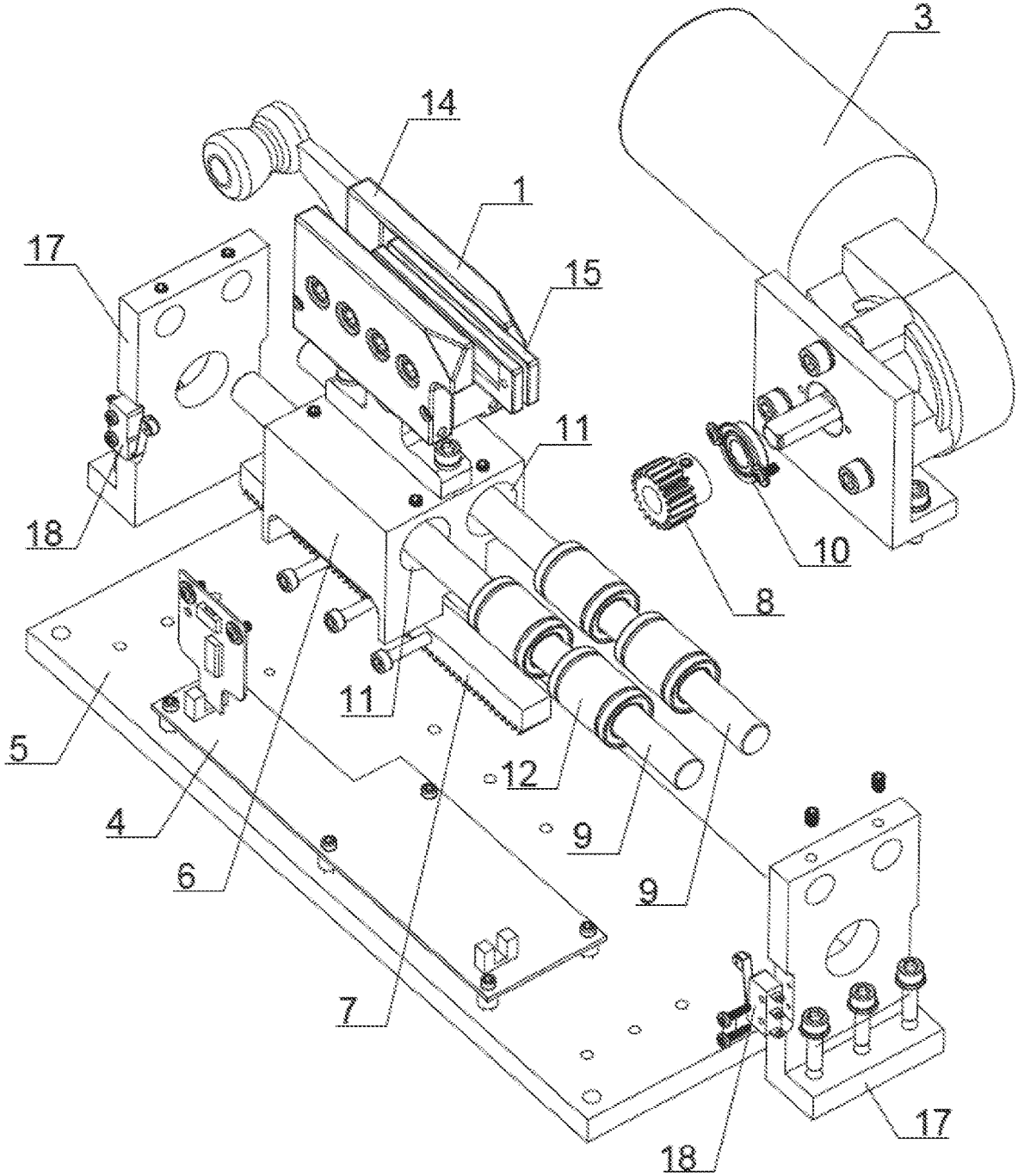
FIG. 2 is an exploded view of a pulling string apparatus of the stringing machine of the present invention.

Referring to FIGS. 1-2, a pulling string apparatus of a stringing machine comprises a string gripper 1, a sensor 2, a drive element 3, a transmission mechanism and a control circuit 4; the sensor 2 is connected with the string gripper 1 to detect the pull force of the string gripper 1, then the detected pull force value is transferred to the control circuit 4; the control circuit 4 will compare the detected pull force value with a pre-set value, and control the rotation of the drive element 3 according to the comparison result.

After the control circuit 4 compares the detected pull force value with a pre-set value, if the detected pull force value is higher than the pre-set value, the control circuit 4 will control the motor to reverse; if the detected value is equal to the pre-set value, the control circuit 4 will stop the motor; if the detected value is lower than the pre-set value, the control circuit 4 will control the motor to forward.

The transmission mechanism of the pulling string apparatus is comprised of a mounting base 5, a transmission sliding block 6, a transmission rack 7 and a drive gear 8; the drive gear 8 is connected to the output shaft of the drive element 3 and is engaged with the transmission rack 7, the sliding block 6 is arranged on the transmission rack 7 and is connected with the sensor 2; the mounting base 5 is configured with two guide rods 9, wherein the sliding block 6 is slidably mounted on the guide rods; when the sensor 2 and the string gripper 1 are driven forward by the sliding block 6 under the act of the transmission rack 7 engaged with the drive gear 8, the racket string will be tensioned; when the sensor and the string gripper are driven backward by the sliding block 6 under the act of the transmission rack 7 engaged with the drive gear 8, the racket string will be loosened.

In this embodiment, the drive element 3 is a motor, and a rolling bearing 10 is arranged between the output shaft of the motor and the drive gear 8.

Specifically, the sliding block 6 is configured with two guide holes 11 in which the guide rods 9 pass through. A plurality of linear bearings 12 are arranged in the guide holes 11 for the sliding block 6 to slide along the guide rods 9.

According to an embodiment of the application, one solution of retaining the linear bearings 12 within the sliding block 6 is to provide shims 13 fixing on both ends of the sliding block 6 in order to prevent the linear bearings 12 from falling out of the sliding block 6.

Specifically, the string gripper 1 comprises a gripper base 14 connected with the sensor 2 and a clamp 15 slidably mounted on the gripper base 14. The clamp 15 comprises inner string slots with a slope, such that the racket strings will be clamped by the clamp 15 steady.

In case of misconduct of the pulling string apparatus, which may lead to the motion of the string gripper 1 out of the safe range, the mounting base 5 is provided with two side plates 17, each of which is arranged with a travel switch 18, and when the string gripper 1 moves to the forward or backward limit position, the travel switch 18 will send a stop signal to the drive element 3 to stop the string gripper 1. In addition, the guide rods 9 are also secured to the side plates 17.

In particular, the pulling string apparatus further comprises a display electrically connected to the control circuit 4 for displaying the pull force value detected by the sensor 2. It is to be noted that embodiments employing a display are not shown in the figures without affecting the understanding.

It is appreciated that the present invention not be limited to the embodiments described above, but that the invention will include such modifications and alterations insofar as they come within the spirit and scope of the invention, the invention is, therefore, claimed in any of its forms or modifications within the proper scope of the appended claims, appropriately interpreted in accordance with the doctrine of equivalents.

What is claimed is:

1. A pulling string apparatus of a stringing machine comprising a string gripper, a sensor, a drive element, a transmission mechanism and a control circuit; the sensor is connected with the string gripper to detect the pull force of the string gripper, then the detected pull force value is transferred to the control circuit; the control circuit compares the detected pull force value with a pre-set value, and control the rotation of the drive element according to the comparison result; the transmission mechanism comprises a mounting base, a sliding block, a transmission rack and a drive gear; wherein the drive gear is connected to an output shaft of the drive element and is engaged with the transmission rack, the sliding block is arranged on the transmission rack and is connected with the sensor; the mounting base is configured with guide rods, wherein the sliding block is slidably mounted on the guide rods; when the sensor and the string gripper are driven forward by the sliding block under the act of the transmission rack engaged with the drive gear, the racket string will be tensioned; when the sensor and the string gripper are driven backward by the sliding block under the act of the transmission rack engaged with the drive gear, the racket string will be loosened.

2. The pulling string apparatus of a stringing machine of claim 1, wherein the sliding block is provided with guide holes in which the guide rods pass through, a plurality of linear bearings are arranged in the guide holes for the sliding block to slide along the guide rods.

3. The pulling string apparatus of a stringing machine of claim 2, wherein the sliding block is configured with shims fixed on both ends of the sliding block by bolts to limit the movement of the linear bearings.

4. The pulling string apparatus of a stringing machine of claim 3, wherein the pulling string apparatus further comprises a display electrically connected to the control circuit for displaying the force value detected by the sensor.

5. The pulling string apparatus of a stringing machine of claim 2, wherein the pulling string apparatus further comprises a display electrically connected to the control circuit for displaying the force value detected by the sensor.

6. The pulling string apparatus of a stringing machine of claim 1, wherein the string gripper comprises a gripper base connected with the sensor and a clamp slidably mounted on the gripper base, the clamp comprises inner string slots with a slope.

7. The pulling string apparatus of a stringing machine of claim 6, wherein the pulling string apparatus further comprises a display electrically connected to the control circuit for displaying the force value detected by the sensor.

8. The pulling string apparatus of a stringing machine of claim 1, wherein the drive element is a motor.

9. The pulling string apparatus of a stringing machine of claim 8, wherein the drive gear is connected to the output shaft of the motor by a rolling bearing.

10. The pulling string apparatus of a stringing machine of claim 9, wherein the pulling string apparatus further comprises a display electrically connected to the control circuit for displaying the force value detected by the sensor.

11. The pulling string apparatus of a stringing machine of claim 8, wherein the pulling string apparatus further comprises a display electrically connected to the control circuit for displaying the force value detected by the sensor.

12. The pulling string apparatus of a stringing machine of claim 1, the pulling string apparatus further comprises two travel switches respectively mounted on two side plates arranged on the mounting base, wherein when the string gripper moves to a forward or backward limit position, the travel switches will send a stop signal to the drive element.

13. The pulling string apparatus of a stringing machine of claim 1, wherein the pulling string apparatus further comprises a display electrically connected to the control circuit for displaying the force value detected by the sensor.

14. The pulling string apparatus of a stringing machine of claim 12, wherein the pulling string apparatus further comprises a display electrically connected to the control circuit for displaying the force value detected by the sensor.

* * * * *